US007276885B1

(12) United States Patent
Tagare

(10) Patent No.: US 7,276,885 B1
(45) Date of Patent: Oct. 2, 2007

(54) APPARATUS AND METHOD FOR POWER SEQUENCING FOR A POWER MANAGEMENT UNIT

(75) Inventor: Madhavi Tagare, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 255 days.

(21) Appl. No.: 11/124,818

(22) Filed: May 9, 2005

(51) Int. Cl.
*G05F 1/577* (2006.01)

(52) U.S. Cl. ..... 323/267; 323/269; 323/281

(58) Field of Classification Search ..... 323/297, 323/268, 269, 272, 273, 281, 282, 267
See application file for complete search history.

(56) References Cited

U.S. PATENT DOCUMENTS 4,920,309 A * 4/1990 Szepesi ..... 323/269
5,717,319 A * 2/1998 Jokinen ..... 323/280
5,747,974 A * 5/1998 Jeon ..... 323/269
5,969,512 A * 10/1999 Matsuyama ..... 323/272
6,031,362 A * 2/2000 Bradley ..... 323/269
6,265,855 B1 * 7/2001 Aas et al. ..... 323/272
6,507,173 B1 1/2003 Spiridon et al.
6,693,410 B1 2/2004 Terrien
6,894,470 B2 * 5/2005 Umemoto et al. ..... 323/281
6,979,985 B2 * 12/2005 Yoshida et al. ..... 323/282
7,095,216 B2 * 8/2006 Matsuo et al. ..... 323/267

OTHER PUBLICATIONS

Maxim Integrated Products Datasheet "Tracking/Sequencing Triple/Quintuple Power-Supply Controllers," 2001, pp. 1-30.
Texas Instruments Datasheet "PTB78520W," SLTS226, Jul. 2004.

* cited by examiner

*Primary Examiner*—Jeffrey Sterrett
(74) *Attorney, Agent, or Firm*—Darby & Darby PC; Matthew M. Gaffney

(57) ABSTRACT

A PMU that includes LDOs is provided. The PMU also includes, for each LDO, a corresponding reference circuit that provides a reference voltage for the LDO. Further, the PMU includes a central bias circuit that provides a reference current to each of the voltage reference circuits. Each reference circuit includes a delay circuit, a counter, a binary-weighted resistor ladder, and switches coupled to the resistor ladder. In each reference circuit, the resistor ladder provides the corresponding reference voltage from the received reference current. Further, the counter controls the switches to "step up" the reference voltage in a well-defined manner during the power-up sequence. The reference voltage is stepped up from a minimum voltage to a final reference voltage by one least significant bit at each clock pulse. Also, the delay circuits are employed to control when each reference voltage begins to increase from the minimum voltage.

20 Claims, 5 Drawing Sheets

APPARATUS AND METHOD FOR POWER SEQUENCING FOR A POWER MANAGEMENT UNIT

FIELD OF THE INVENTION

The invention is related to power-supply controllers, and in particular, to an apparatus and method for a well-defined power-up sequence for output voltages of a power management unit.

BACKGROUND OF THE INVENTION

Portable devices, e.g., cell phones, pagers, laptop computers, personal digital assistants, and the like, may require accurate, stable, low-dropout regulated voltages to various sensitive load modules in such devices. Such load modules may vary with each device, but may include digital loads, analog loads, a reference oscillator, a real time clock, and/or the like. Such devices are typically powered by a battery, but may be powered with other voltage sources such as a solar source. Such power sources often provide unregulated voltage. A battery may provide a voltage source that varies considerably over its useful life and with the amount of load placed on it. When multiple batteries are used in series, such problems may be compounded. Thus, the various load modules in such devices typically cannot operate off direct battery voltage.

To condition an input voltage source and provide a regulated supply voltage to separate load modules in such devices, a low-dropout voltage regulator (LDO) is typically utilized. LDOs are typically integrated circuits that provide conditioned output voltages over varying loads with minimal voltage dropout over a relatively wide input voltage and operating temperature range. LDOs may provide a fixed output voltage or a varied output voltage. Other portable devices may have a power management unit (PMU) including one or more LDOs to condition an input voltage source and provide a regulated supply voltage to separate load modules and to provide other functionality.

BRIEF DESCRIPTION OF THE DRAWINGS

Non-limiting and non-exhaustive embodiments of the present invention are described with reference to the following drawings, in which.

DETAILED DESCRIPTION

Figure 1:
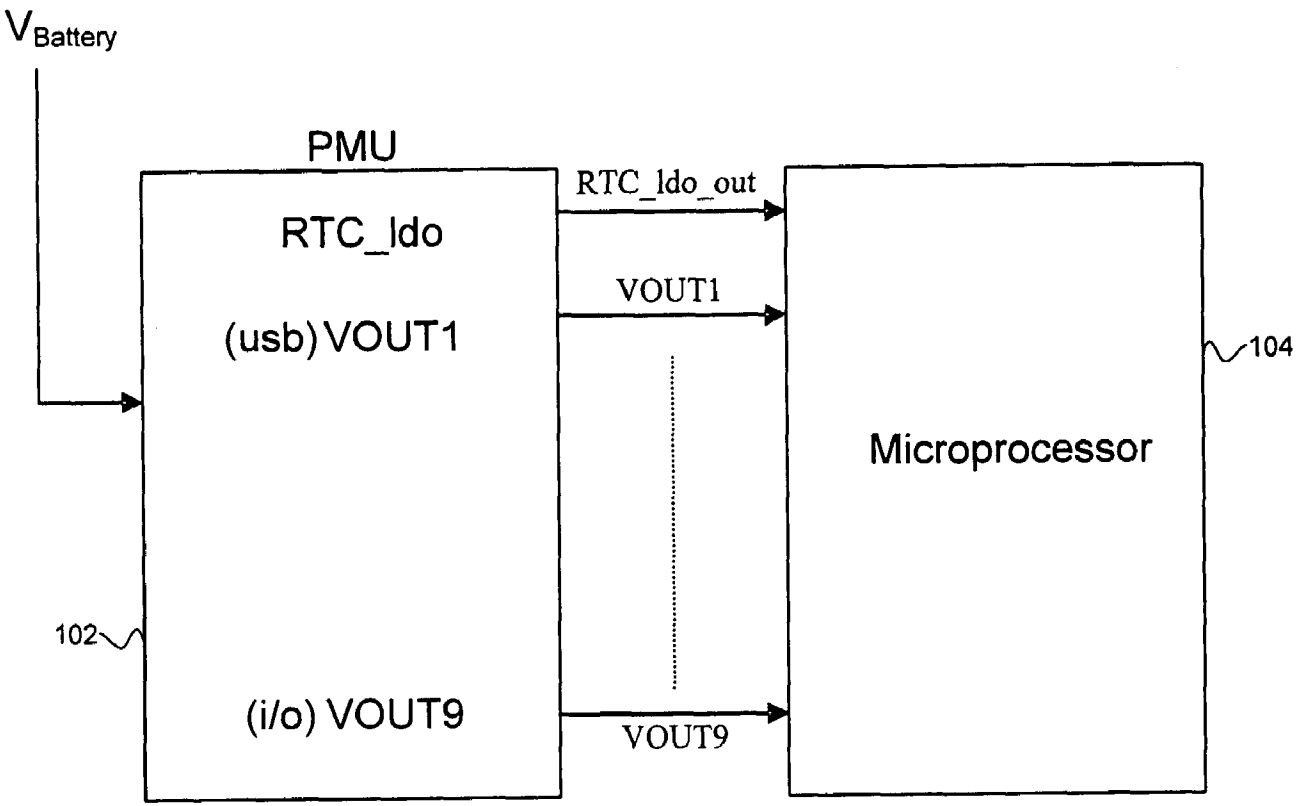
FIG. 1 illustrates a block diagram of an embodiment of a system including a power management unit and a microprocessor.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto.

Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar junction transistor (BJT) may be employed as an embodiment of a transistor, the scope of the words "gate", "drain", and "source" includes "base", "collector", and "emitter", respectively, and vice versa.

Briefly stated, the invention is related to a PMU that is arranged as follows in one embodiment. The PMU includes LDOs, and the PMU also includes, for each LDO, a corresponding reference circuit that provides a reference voltage for the LDO. Further, the PMU includes a central bias circuit that provides a reference current to each of the voltage reference circuits. Each reference circuit includes a delay circuit, a counter, a binary-weighted resistor ladder, and switches coupled to the resistor ladder. In each reference circuit, the resistor ladder provides the corresponding reference voltage from the received reference current. Further, the counter controls the switches to "step up" the reference voltage in a well-defined manner during the power-up sequence. The reference voltage is stepped up from a minimum voltage to a final reference voltage by one least significant bit at each clock pulse. Also, the delay circuits are employed to control when each reference voltage begins to increase from the minimum voltage.

FIG. 1 illustrates a block diagram of an embodiment of system 100. System 100 includes power management unit (PMU) 102 and microprocessor 104.

In one embodiment, PMU 102 is arranged to receive battery voltage $V_{Battery}$. PMU 102 is arranged to provide output voltages, e.g. output voltages VOUT1-VOUT9. Although nine output voltages are illustrated in FIG. 1, in other embodiments, more or less output voltages may be provided by PMU 102. Also, in one embodiment, PMU 102 is arranged to provide signal RTC_1do_out, which is suitable for powering a real time clock (RTC). In other embodiments, PMU 102 does not provide signal RTC_1do_out.

Although not shown in FIG. 1, microprocessor 104 may include various load modules that cannot run directly off a battery, including digital loads, analog loads, a reference oscillator, and/or an RTC. Microprocessor 104 is arranged to receive signals from PMU 102, including, in one embodiment, RTC_1do_out and output voltages VOUT1-VOUT9 for driving the load modules that cannot run directly off the battery.

Additionally, PMU 102 is arranged to provide output voltages (e.g. VOUT1-VOUT9) such that, during a start-up sequence, the output voltages increase to their final values in a well-defined manner. Further, in one embodiment, the time at which each output voltage increases is controllable. For example, in this embodiment, the start-up sequence may be controlled so that voltage VOUT2 begins increasing to its final value N clock cycles after VOUT1 begins increasing to its final value, or vice versa, where N is selectable. Also, the well-defined increase is substantially similar for each output voltage, so that two output voltages that begin increasing at the same time track each other as they increase.

For PMU 102, the rate of increase of each of the output voltages is substantially independent of the load currents. Further, in PMU 102, neither external components nor an external reference voltage is required to attain the power sequencing.

In one embodiment, for each output voltage, when the output voltage begins increasing, the output voltage increases by one small voltage increment with each clock cycle, until the output voltage reaches its final value.

In one embodiment, PMU 102 is an integrated circuit.

Figure 2:
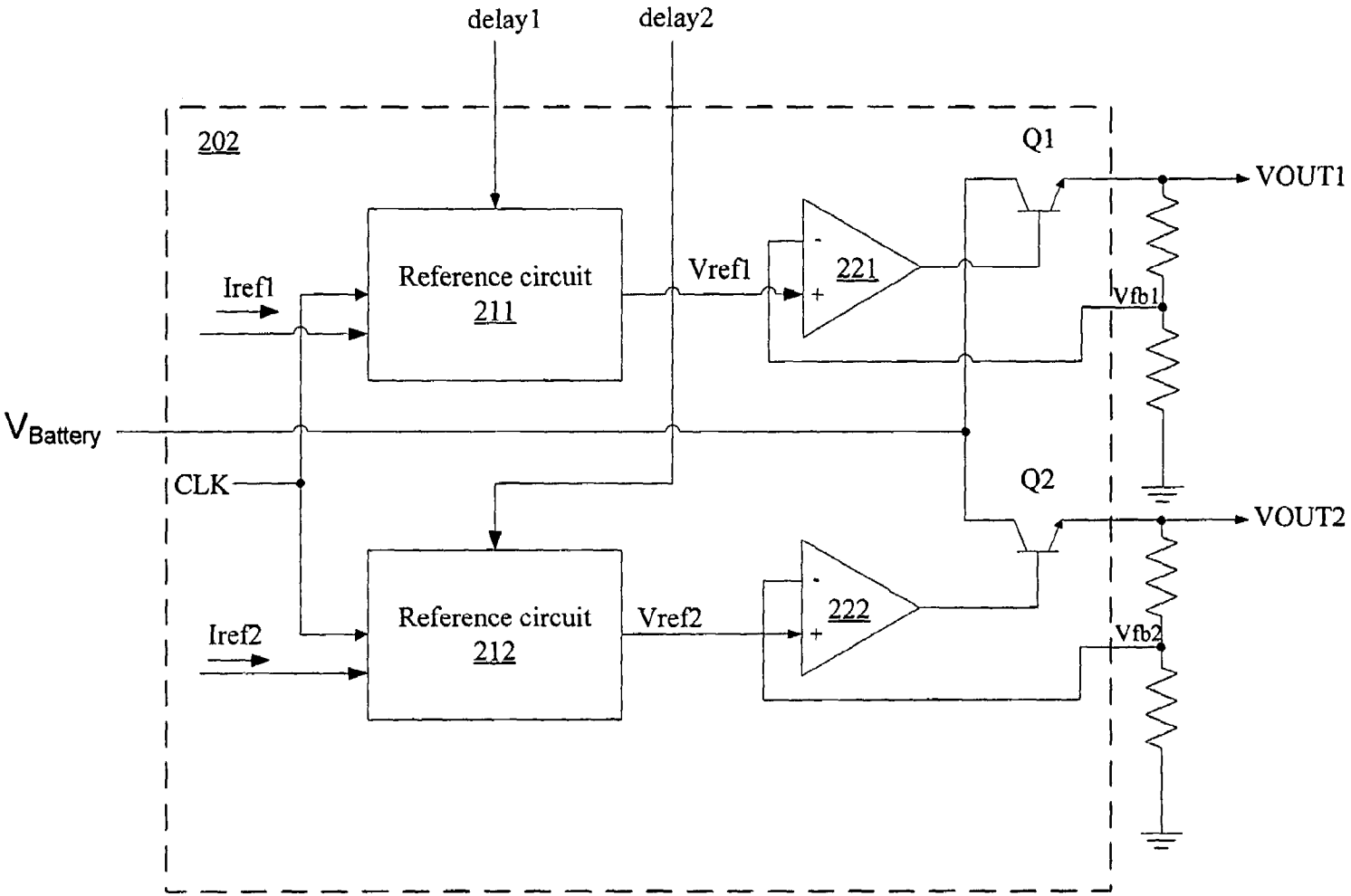
FIG. 2 shows a block diagram of an embodiment of the power management unit of FIG. 1.

FIG. 2 shows a block diagram of an embodiment of PMU 202, which may be employed as an embodiment of PMU 102 of FIG. 1. PMU 202 may include reference circuits 211 and 212, error amplifiers 221 and 222, and pass transistors Q1 and Q2.

As shown in FIG. 2, PMU 202 includes a plurality of reference circuits and a plurality of regulator control circuits. Also, as shown in FIG. 2, in one embodiment, each regulator control circuit includes an error amplifier. Although linear regulators are illustrated in FIG. 2, in other embodiments, other types of regulators may be employed. In one embodiment, each of the regulators is an LDO. In another embodiment, each of the regulators is a switching regulator, switched-capacitor based regulator, or the like.

Reference circuits 211 and 212 are each arranged to receive clock signal CLK. In one embodiment, clock signal CLK is provided by an oscillator circuit (not shown in FIG. 2) in PMU 202. Also, reference circuit 211 may be arranged to receive delay signal delay1, and reference circuit 212 may be arranged to receive delay signal delay2.

Signal CLK begins oscillating in a power-up sequence. Additionally, reference circuit 211 is arranged to provide reference voltage Vref1 such that reference voltage Vref1 begins increasing from a minimum value ($Vref1_{min}$) to a final value for reference voltage Vref1 ($Vref1_{final}$) at a time based in part in signal delay1. In one embodiment, reference voltage Vref1 begins increasing from $Vref1_{min}$ to $Vref1_{final}$ when D1 clock pulses occur in signal CLK, where D1 is a value associated with signal delay1.

Similarly, in this embodiment, reference voltage Vref2 begins increasing from $Vref2_{min}$ to $Vref2_{final}$ when D2 clock pulses occur in signal CLK, where D2 is a value associated with signal delay2.

Signals delay1 and delay2 may be employed to enable each output voltage to begin ramping up with a selectable delay. A delay of zero may be selected if no delay is desired.

Reference circuit 211 is arranged to provide voltage Vref1 based in part on reference current Iref1, and reference circuit 212 is arranged to provide voltage Vref2 based in part on reference current Iref2, where current Iref1 is substantially similar to current Iref2.

Also, a first regulator (including error amplifier 221 and pass transistor Q1 in one embodiment) is arranged to provide output voltage VOUT1 based on a difference between feedback voltage Vfb1 and reference voltage Vref1, and a second regulator (including error amplifier 222 and pass transistor Q2 in one embodiment) is arranged to provide output voltage VOUT2 based on a difference between feedback voltage Vfb2 and reference voltage Vref2.

Delay signals are described above for one embodiment in which the point in time that each of the output voltages begins increasing is selectable by a user. In another embodiment, delay signals are not provided, and reference voltage Vref1 and Vref2 begin increasing at the same time, or at different times that are not selectable by the user.

Figure 3:
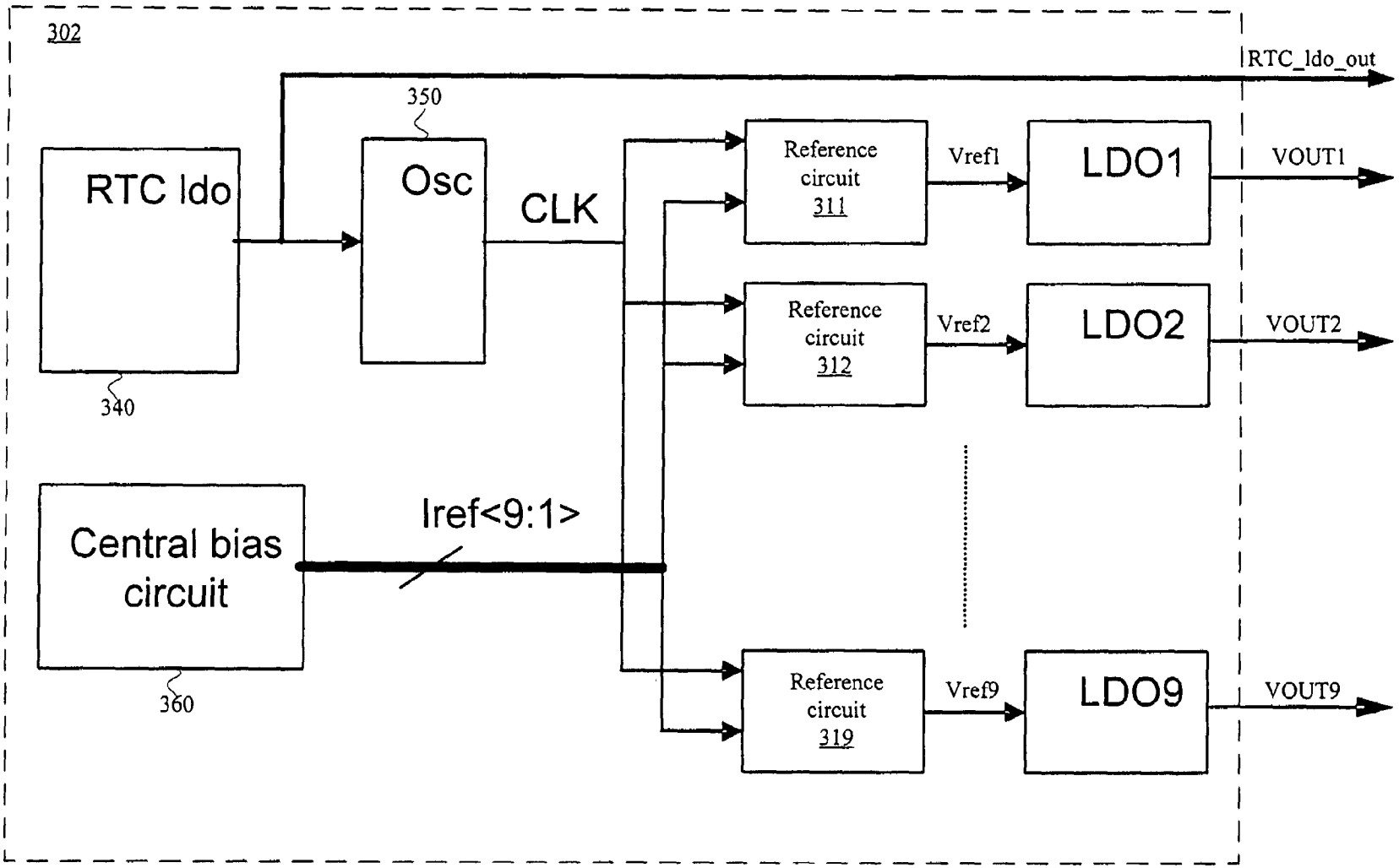
FIG. 3 illustrates another embodiment of the power management unit of FIG. 1.

FIG. 3 illustrates an embodiment of PMU 302, which may be employed as an embodiment of PMU 102 of FIG. 1. PMU 302 includes RTC LDO 340, oscillator circuit 350, central bias circuit 360, reference circuits 311-319, and LDOs LDO1-LDO9. Components in FIG. 3 are arranged to operate in a substantially similar manner to similarly-named components discussed above with reference to FIGS. 1 and 2, and may operate in a different manner in some ways. Although an example embodiment arranged to provide nine output voltages is illustrated in FIG. 3, in other embodiments, more or less output voltages may be employed.

In operation, central bias circuit 360 provides reference currents I1-I9 such that reference currents I1-I9 are substantially the same as each other. Additionally, RTC LDO 340 may be arranged to provide signal RTC_1do_out such that signal RTC_1do_out comes on at power-up with substantially no delay. Oscillator circuit 350 is arranged to be powered by signal RTC_1do_out. Also, oscillator circuit 350 is arranged to provide clock signal CLK.

Reference circuits 311-319 are arranged to provide signals Vref1-Vref9 respectively based on signal CLK, and based on reference currents Iref1-Iref9, respectively. In one embodiment, reference circuits 311-319 are also each arranged to receive a separate delay signal for providing a selectable delay, as discussed above. In another embodiment, reference circuits 311-319 do not receive delay signals. Each of LDO1-LD09 is arranged to provide output voltage VOUT1-VOUT9 from reference voltages Vref1-Vref9, respectively.

Figure 4:
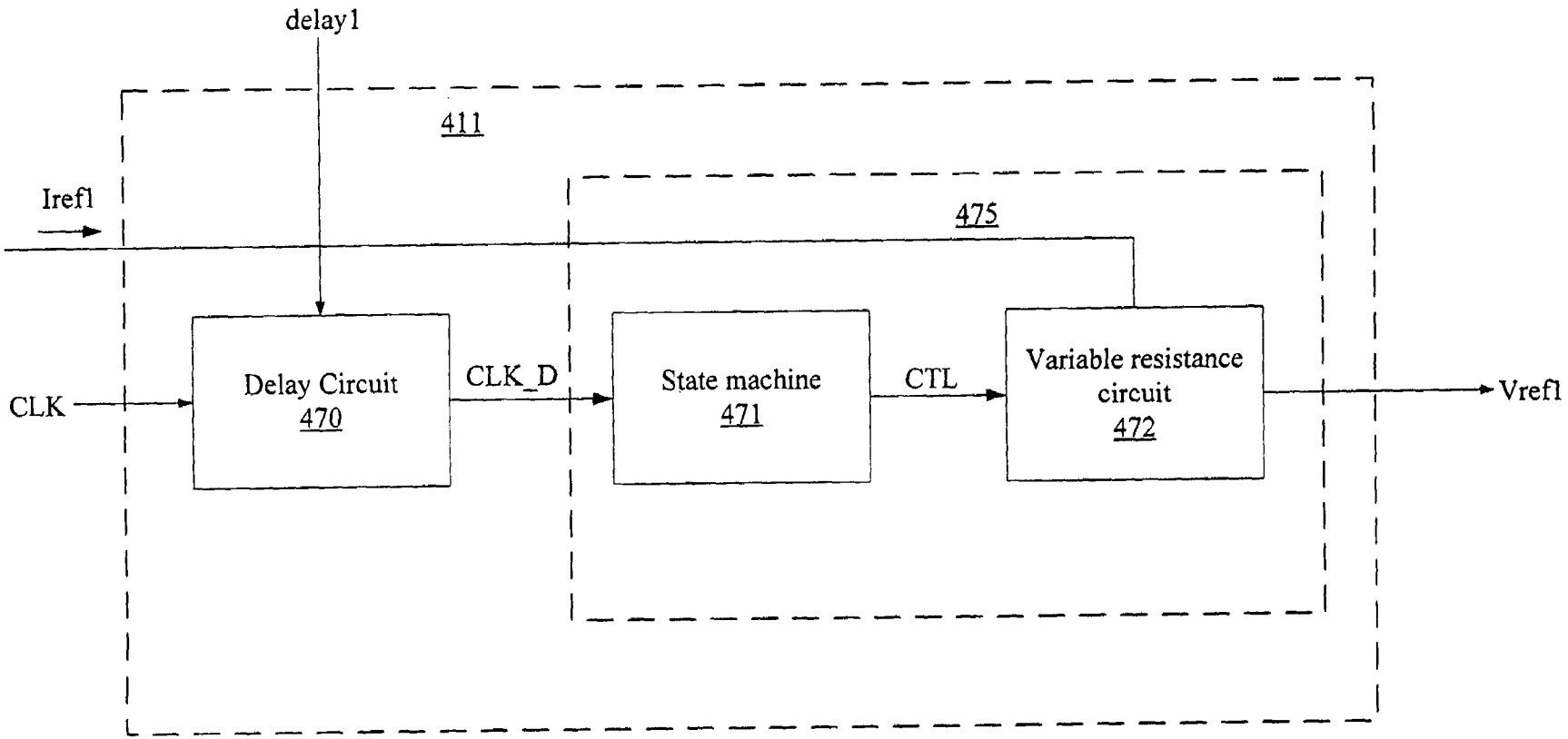
FIG. 4 shows a block diagram of an embodiment of the reference circuit of FIGS. 2 and/or 3.

FIG. 4 shows a block diagram of an embodiment of reference circuit 411, which may be employed as an embodiment of reference circuit 211 of FIG. 2 and/or reference circuit 311 of FIG. 3, respectively. Reference circuit 411 includes reference voltage circuit 475. Voltage reference circuit 475 may include state machine 471 and variable resistance circuit 472. In one embodiment, reference circuit 411 further includes delay circuit 470. In another embodiment, reference circuit 411 does not include delay circuit 470, and in this embodiment, clock signal CLK (instead of signal CLK_D) goes directly to state machine 471.

In operation, voltage reference circuit 475 provides reference voltage Vref1 based, in part, on clock signal CLK.

In one embodiment, delay circuit 470 is arranged to provide signal CLK_D from clock signal CLK. In one embodiment, delay circuit 470 may be arranged to provide signal CLK_D such that CLK_D is substantially the same as clock signal CLK, except that signal CLK_D is delayed relative to clock signal CLK by a number of clock pulses that corresponds to a value that is associated with delay signal delay1.

State machine 471 is arranged to provide control signal CTL based on signal CLK_D (or based directly on signal CLK, in an embodiment in which delay circuit 470 is not included). When the input clock to state machine 471 begins oscillating, state machine 471 adjusts signal CTL to adjust a resistance associated with variable resistance circuit 472. When voltage Vref1 reaches $Vref1_{final}$, state machine 471 stops adjusting signal CTL. In one embodiment, state machine 471 is an eight-bit counter that counts from 00 to FF, and stops counting when FF is reached. In other embodiments, state machine 471 may be a type of state machine other than a counter.

Variable resistance circuit 472 is arranged to provide reference voltage Vref1 based on reference current Iref1, and further based on a resistance associated with variable resistance circuit 472. The resistance associated with variable resistance circuit 472 is adjustable based on control signal CTL In one embodiment, variable resistance circuit 472 includes a plurality of resistive elements that are arranged to provide reference Vref1 based on reference current Iref, and further includes a plurality of switch circuits coupled to the resistive elements. In this embodiment, the switch circuits are arranged to open and close responsive to signal CTL.

Figure 5:
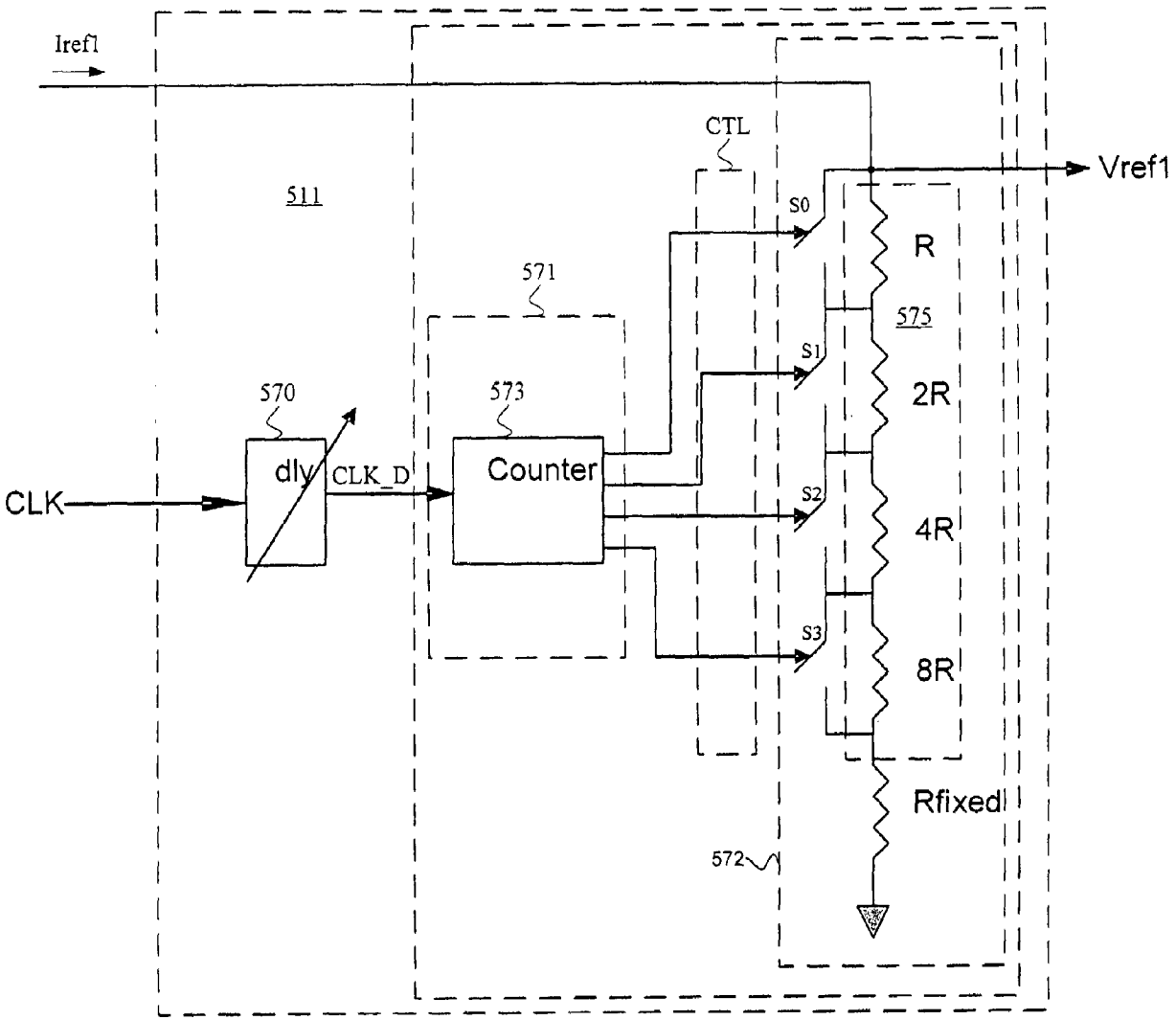
FIG. 5 illustrates a block diagram of an embodiment of the reference circuit of FIG. 4, arranged in accordance with aspects of the present invention.

FIG. 5 illustrates a block diagram of an embodiment of reference circuit 511. Reference circuit 511 may be employed as an embodiment of reference circuit 411 of FIG. 4. State machine 571 includes counter 573. Variable resistance circuit 572 includes switch circuits S0-S3, binary-weighed resistor ladder 575, and resistor circuit Rfixed.

In one embodiment, counter 573 is a four-bit counter that is arranged to provide control signal CTL as a four-bit signal. In other embodiments, a number of bits other than four may be employed. Each of the switch circuits S0-S3 is arranged to open and close responsive to a separate bit of control signal CTL.

In one embodiment, counter 573 counts from 0000 to 1111. In this embodiment, each switch circuit S0-S3 is closed when the corresponding bit of signal CTL is a 0, and open when the corresponding bit of signal CTL is a 1. Also, in this embodiment, counter 573 stops counting when 1111 is reached. Further, the total equivalent resistance of binary-weighted resistor ladder 575 may be given by R*COUNT, where COUNT represents the current count of counter 573. Accordingly, the total equivalent resistance of binary-weighted resistor ladder 575 may be given by Rfixed+R*COUNT. Reference voltage Vref1 may be given by Vref1=Iref1*(Rfixed+R*COUNT).

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A power management unit, comprising:

a first regulator control circuit that is arranged to provide a first output voltage, wherein the first regulator control circuit performs regulation based, in part, on a difference between a first feedback signal and a first reference voltage;

a second regulator control circuit that is arranged to provide a second output voltage, wherein the second regulator control circuit performs regulation based, in part, on a difference between a second feedback signal and a second reference voltage;

a first plurality of resistive elements that is arranged to receive a first reference current, and further arranged to provide the first reference voltage based, in part, on the first reference current;

a first plurality of switch circuits coupled to the first plurality of resistive elements, wherein the switch circuits of the first plurality of switch circuits are arranged to open and close responsive to a first switch control signal;

a first state machine that is arranged to provide the first switch control signal as a multi-bit digital signal having a value that changes over time during a power-up sequence such that a total equivalent resistance of the first plurality of resistive elements increases in a time-controlled manner during the power-up sequence;

a second plurality of resistive elements that is arranged to receive a second reference current, and further arranged to provide the second reference voltage based, in part, on the second reference current; and a second plurality of switch circuits coupled to the second plurality of resistive elements, wherein the switch circuits of the second plurality of switch circuits are arranged to open and close responsive to a second switch control signal.

2. The power management unit of claim 1, wherein the first regulator control circuit is a low-dropout regulator control circuit, and wherein the second regulator control circuit is another low-dropout regulator control circuit.

3. The power management unit of claim 1, further comprising:

a central bias circuit that is arranged to provide a plurality of reference currents including the first reference current and the second reference current, and wherein the central bias circuit is arranged to provide the plurality of reference currents such that each reference current in the plurality of reference currents is substantially the same.

4. The power management unit of claim 1, wherein the first plurality of resistive elements and the first plurality of switch circuits are arranged such that a portion of the first reference voltage is proportional to the value associated with the first switch control signal, and wherein the second plurality of resistive elements and the second plurality of switch circuits are arranged such that a portion of the second reference voltage is proportional to a value associated with the second switch control signal.

5. The power management unit of claim 1, wherein the first plurality of resistive elements includes a resistor ladder.

6. The power management unit of claim 5, wherein:

the resistor ladder includes a binary-weighted resistor ladder and a fixed resistance circuit.

7. The power management unit of claim 6, wherein the binary weighted resistor ladder includes:

a first resistor having a resistance of R, a second resistor having a resistance of about 2*R, a third resistor having a resistance of about 4*R, and a fourth resistor having a resistance of about 8*R;

the fixed resistance circuit includes a fifth resistor, wherein the fifth resistor is coupled in series with the binary weighted resistor ladder; and wherein first, second, third, and fourth resistors are coupled in series;

the first state machine is arranged to provide the first switch control signal such that the first switch control signal includes a first bit, a second bit, a third bit, and a fourth bit; and wherein the first plurality of switch circuits includes:

a first switch circuit that is coupled in parallel with the first resistor, wherein the first switch circuit is arranged to close if the first bit of the first switch control signal is asserted, and to open if the first bit of the first switch control signal is unasserted;

a second switch circuit that is coupled in parallel with the second resistor, wherein the second switch circuit is arranged to close if the second bit of the first switch control signal is asserted, and to open if the second bit of the first switch control signal is unasserted;

a third switch circuit that is coupled in parallel with the third resistor, wherein the third switch circuit is arranged to close if the third bit of the first switch control signal is asserted, and to open if the third bit of the first switch control signal is unasserted; and a fourth switch circuit that is coupled in parallel with the fourth resistor, wherein the fourth switch circuit is arranged to close if the fourth bit of the first switch control signal is asserted, and to open if the fourth bit of the first switch control signal is unasserted.

8. A power management unit, comprising:

a first regulator control circuit that is arranged to provide a first output voltage, wherein the first regulator control circuit performs regulation based, in part, on a difference between a first feedback signal and a first reference voltage;

a second regulator control circuit that is arranged to provide a second output voltage, wherein the second regulator control circuit performs regulation based, in part, on a difference between a second feedback signal and a second reference voltage;

a first plurality of resistive elements that is arranged to receive a first reference current, and further arranged to provide the first reference voltage based, in part, on the first reference current;

a first plurality of switch circuits coupled to the first plurality of resistive elements, wherein the switch circuits of the first plurality of switch circuits are arranged to open and close responsive to a first switch control signal;

a first state machine that is arranged to provide the first switch control signal as a multi-bit digital signal having a value that changes over time during a power-up sequence such that a total equivalent resistance of the first plurality of resistive elements increases in a time-controlled manner during the power-up sequence;

a second plurality of resistive elements that is arranged to receive a second reference current, and further arranged to provide the second reference voltage based in part, on the second reference current; and a second plurality of switch circuits coupled to the second plurality of resistive elements, wherein the switch circuits of the second plurality of switch circuits are arranged to open and close responsive to a second switch control signal, wherein the state machine includes a first counter circuit that is arranged to provide the first switch control signal based, in part, on a first counter input clock signal; and wherein the first counter input clock signal is based, at least in part, on an oscillator clock signal.

9. The power management unit of claim 8, further comprising:

a second counter circuit that is arranged to provide the second switch control signal, wherein the second counter circuit is arranged to provide the second switch control signal based, in part, on a second counter input clock signal; and wherein the second counter input clock signal is based, at least in part, on the oscillator clock signal.

10. The power management unit of claim 9, further comprising:

a first delay circuit that is arranged to provide the first counter input clock signal from the oscillator clock, wherein the first delay circuit is arranged to receive a first delay signal having a first delay value, and wherein the first counter input clock signal is delayed relative to the oscillator clock signal based on the first delay value;

a second delay circuit that is arranged to provide the second counter input clock signal from the oscillator clock, wherein the second delay circuit is arranged to receive a second delay signal having a second delay value; the second counter input clock signal is delayed relative to the oscillator clock based on the second delay value; the first counter circuit is arranged to provide the first switch control signal such that the value associated with the first switch control signal increments for each pulse of the first counter input clock signal until a final value is reached; and wherein the second counter circuit is arranged to provide the second switch control signal such that the value associated with the second switch control signal increments for each pulse of the second counter input clock signal until another final value is reached.

11. The power management unit of claim 10, wherein the first plurality of resistive elements and the first plurality of switch circuits are arranged such that a portion of the first reference voltage is proportional to the value associated with the first switch control signal, and wherein the second plurality of resistive elements and the second plurality of switch circuits are arranged such that a portion of the second reference voltage is proportional to the value associated with the second switch control signal.

12. The power management unit of claim 10, wherein the first counter circuit is arranged such that each of the bits of the first switch control signal is 0 at the beginning of the power up sequence; and such that, at the final value of the first switch control signal, each of the bits of the first control signal is 1.

13. The power management unit of claim 10, further comprising:

a real-time clock regulator that is arranged to provide a real-time clock regulator output voltage at about the beginning of the power-up sequence; and an oscillator circuit that is arranged to provide the oscillator clock signal, wherein the oscillator circuit is arranged to receive the real-time clock regulator output voltage as a power supply voltage for the oscillator circuit.

14. A power management unit, comprising:

a first delay circuit that is arranged to receive an input clock signal and a first delay signal having a selectable first delay value of at least zero, and further arranged to provide a first delay circuit output clock signal such that the first delay circuit output clock signal is delayed relative to the input clock signal, and such that the delay of the first delay circuit output clock signal relative to the input clock signal is proportional to the first delay value;

a first reference voltage circuit that is arranged to, responsive to the first delay circuit output clock signal, provide a first reference voltage such that the first reference voltage increases with each pulse of the first delay circuit output clock signal until the first reference voltage reaches a final value for the first reference voltage;

a second delay circuit that is arranged to receive the input clock signal and a second delay signal having a selectable second delay value of at least zero, and further arranged to provide a second delay circuit output clock signal such that the second delay circuit output clock signal is delayed relative to the input clock signal, and such that the delay of the second delay circuit output clock signal relative to the input clock signal is proportional to the second delay value; and a second reference voltage circuit that is arranged to, responsive to the second delay circuit output clock signal, provide a second reference voltage such that the second reference voltage increases with each pulse of the second delay clock output clock signal until the second reference voltage reaches a final value for the second reference voltage.

15. The circuit of claim 14, wherein the first reference voltage circuit includes:

a first counter circuit that is arranged to provide a first switch control signal based on the first delay circuit output clock signal such that a first count value of the first switch control signal increments with each pulse of the first delay clock output signal until the first count value reaches a final value for the first count value;

a first binary-weighted resistor ladder that is arranged to receive a first reference current;

a first resistor circuit having a fixed resistance, wherein the first resistor circuit is coupled in series with the first binary-weighted resistor ladder; and a plurality of switch circuits arranged in cooperation with the first binary-weighted resistor ladder such that a total equivalent resistance of the first binary-weighted resistor ladder is substantially proportional to the first count value; and wherein the second reference voltage circuit includes:

a second counter circuit that is arranged to provide a second switch control signal based on the second delay circuit output clock signal such that a second count value of the second switch control signal increments with each pulse of the second delay clock output signal until the second count value reaches a final value for the second count value;

a second binary-weighted resistor ladder that is arranged to receive a second reference current;

a second resistor circuit having a fixed resistance, wherein the second resistor circuit is coupled in series with the second binary-weighted resistor ladder; and a plurality of switch circuits arranged in cooperation with the second binary resistor ladder such that a total equivalent resistance of the second binary-weighted resistor ladder is substantially proportional to the second count value.

16. The circuit of claim 14, wherein the first reference circuit is arranged to provide the first reference voltage responsive to a first reference current, the second reference circuit is arranged to provide the second reference voltage responsive to a second reference current, and wherein the first reference current is substantially the same as the second reference current.

17. The circuit of claim 14, further comprising:

a first low-dropout regulator circuit that is arranged to provide a first output voltage based on a first feedback voltage and the first reference voltage, wherein the first feedback voltage is based, at least in part, on the first output voltage; and a second low-dropout regulator circuit that is arranged to provide a second output voltage based on a second feedback voltage and the second reference voltage, wherein the second feedback voltage is based, at least in part, on the second output voltage.

18. A method for power sequencing, comprising:

during a power-up sequence:

counting to provide a first count signal, wherein the first count signal is a multi-bit digital signal having a first count value; and counting to provide a second count signal, wherein the second count signal is a multi-bit digital signal having a second count value;

employing the first count signal to control a first plurality of switch circuits coupled to a first resistor ladder such that a total equivalent resistance of the first resistor ladder is based, in part, on the first count value;

providing a first reference current to the first resistor ladder such that a first reference voltage is provided by the first resistor ladder;

employing the second count signal to control a second plurality of switch circuits coupled to a second resistor ladder such that a total equivalent resistance of the second resistor ladder is based, in part, on the second count value;

providing a second reference current to the second resistor ladder such that a second reference voltage is provided by the second resistor ladder;

providing a first output voltage, wherein providing the first output voltage includes:

performing regulation based, in part, on a difference between a feedback signal and the first reference voltage;

providing a second output voltage, wherein providing the second output voltage includes:

performing regulation based, in part, on a difference between a feedback signal and the second reference voltage.

19. The method of claim 18, further comprising:

during the power-up sequence:

providing a first delayed clock signal such that the first delayed clock signal is delayed relative to an input clock signal, and such that the delay of the first delayed clock signal relative to the input clock signal is proportional to a first selectable delay value; and providing a second delayed clock signal such that the second delayed clock signal is delayed relative to an input clock signal, and such that the delay of the second delayed clock signal relative to the input clock signal is proportional to a second selectable delay value, wherein the counting of the first count signal is accomplished such that, until the first count value reaches a final value, the first count value increments with each pulse of the first delayed clock signal; and such that, until the second count value reaches another final value, the second count value increments with each pulse of the second delayed clock signal.

20. The method of claim 18, wherein counting to provide the first count value includes:

initializing the first count value to a value such that each bit of the first count value is a 0;

at each pulse of the first delayed clock signal, incrementing the first count value by one; and ceasing counting when the each bit of the first count value is a 1.

* * * * *

UNITED STATES PATENT AND TRADEMARK OFFICE

CERTIFICATE OF CORRECTION

PATENT NO. : 7,276,885 B1
APPLICATION NO. : 11/124818
DATED : October 2, 2007
INVENTOR(S) : Tagare It is certified that error appears in the above-identified patent and that said Letters Patent is hereby corrected as shown below:

In column 2, line 52, delete “1do” and insert -- ldo --, therefor.

In column 2, line 54, delete “1do” and insert -- ldo --, therefor.

In column 2, line 60, delete “1do” and insert -- ldo --, therefor.

In column 4, line 21, delete “1do” and insert -- ldo --, therefor.

In column 4, line 22, delete “1do” and insert -- ldo --, therefor.

In column 4, line 24, delete “1do” and insert -- ldo --, therefor.

In column 4, line 33, delete “LD09” and insert -- LDO9 --, therefor.

In column 7, line 37, in Claim 8, delete “based” and insert -- based, --, therefor.

Signed and Sealed this

Fourth Day of December, 2007

JON W. DUDAS
*Director of the United States Patent and Trademark Office*